United States Patent [19]

Childers

[11] Patent Number: 4,957,225

[45] Date of Patent: Sep. 18, 1990

[54] REPLACEABLE CAULKING TIP FOR USE ON CAULKING CARTRIDGES AND METHOD OF MANUFACTURE

[76] Inventor: Steven M. Childers, 155 W. Clover Rd., Tracy, Calif. 95376

[21] Appl. No.: 257,623

[22] Filed: Oct. 14, 1988

Related U.S. Application Data

[63] Continuation-in-part of Ser. No. 884,047, Jul. 10, 1986, abandoned.

[51] Int. Cl.[5] ..... B65D 25/40

[52] U.S. Cl. ..... 222/568; 425/87; 425/458

[58] Field of Search ..... 222/325, 326, 327, 391, 222/562, 566–568, 570, 575, 541; 425/87, 458; 239/390, 391, 397, 600; 401/261, 263, 265, 266

[56] References Cited

U.S. PATENT DOCUMENTS

| | | | |
|---|---|---|---|
| 2,365,524 | 12/1944 | Court | 222/107 X |
| 2,754,033 | 7/1956 | Etter | 222/326 |
| 2,815,895 | 12/1957 | Reed | 222/568 |
| 2,833,444 | 5/1958 | Sherbondy | 222/541 X |
| 2,836,333 | 5/1958 | Woodel | 222/566 X |
| 2,953,285 | 9/1960 | McKelvey | 222/567 |
| 2,981,449 | 4/1961 | Perkins | 222/570 X |
| 3,042,268 | 7/1962 | Pyles | 222/327 |
| 3,058,632 | 10/1962 | Stremmel | 222/567 |
| 3,145,413 | 8/1964 | Alsleben | 401/266 |
| 3,658,213 | 4/1972 | Plumer | 222/327 X |
| 3,841,537 | 10/1974 | Marg et al. | 222/541 |
| 4,258,884 | 3/1981 | Rogers | 239/390 |
| 4,284,213 | 8/1981 | Lee | 222/541 |
| 4,382,530 | 5/1983 | Calisto | 222/567 |
| 4,600,125 | 7/1986 | Maynard, Jr. | 222/460 X |
| 4,637,531 | 1/1987 | Olsson | 222/570 |

*Primary Examiner*—Kevin P. Shaver

*Attorney, Agent, or Firm*—John A. Bucher

[57] ABSTRACT

A replaceable caulking tip is disclosed for use on the tubular nozzle of a caulking cartridge or the like. The tip includes a tubular body which is internally threaded for replaceable engagement on the nozzle. An outlet orifice is formed at the other end of the body with substantial body material surrounding the orifice to permit shaping of the tip, and reshaping if necessary. The orifice is inclined about 12 to 20 degrees, preferably about 15 to 17 degrees, from a plane perpendicular to a longitudinal axis of the tip and is of elongated configuration. The body of the tip is preferably formed from a hard material permitting shaping of the body yet facilitating repeated use of the tip, the body material being rounded or faired about the orifice. An indexing notch is formed on the body to assure proper angular alignment of the tubular body during steps of inclining and elongated the orifice in a method of manufacture.

22 Claims, 1 Drawing Sheet

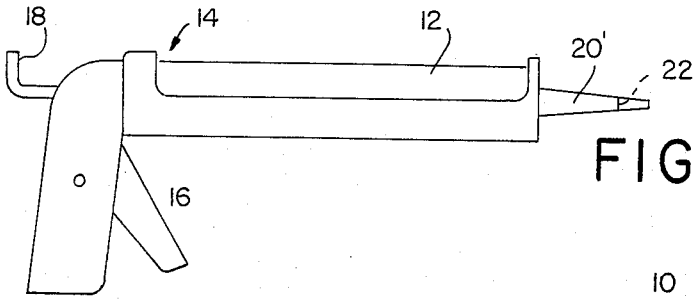
FIG. 1
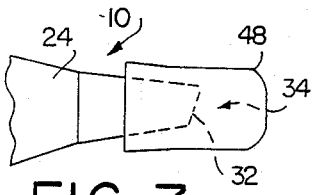
FIG. 7
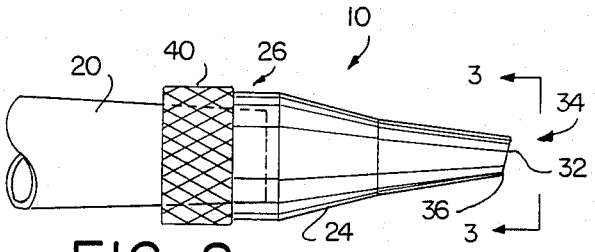
FIG. 2
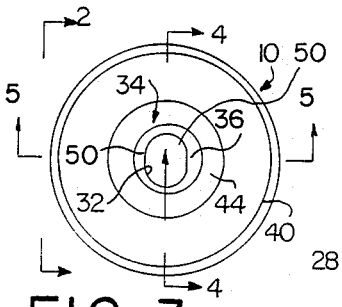
FIG. 3
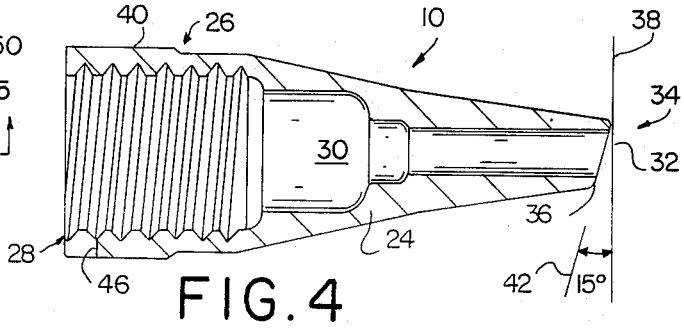
FIG. 4
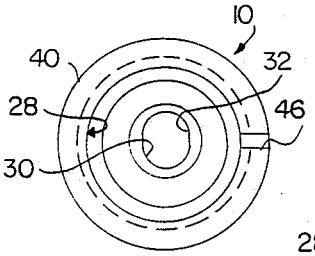
FIG. 6
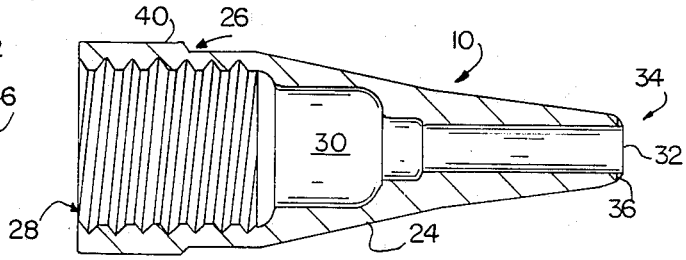
FIG. 5
FIG. 8
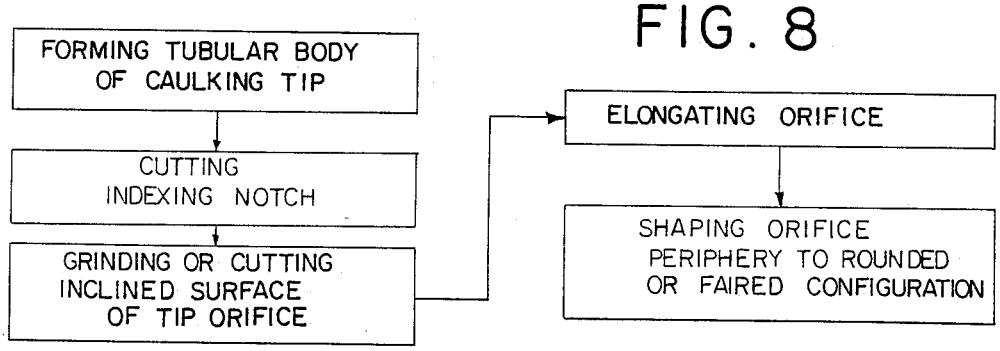

REPLACEABLE CAULKING TIP FOR USE ON CAULKING CARTRIDGES AND METHOD OF MANUFACTURE

This is a continuation-in-part of copending application Ser. No. 06/884,047 filed on July 10, 1986 now abandoned.

FIELD OF THE INVENTION

The present invention relates to a replaceable caulking tip for use on caulking cartridges and the like, and a method of forming the caulking tip.

BACKGROUND OF THE INVENTION

This is a continuation-in-part of U.S. patent application, Ser. No. 884,047, filed July 10, 1986 and now abandoned.

A wide variety of caulking cartridges has long been employed for use in a number of applications. These cartridges are commonly used in caulking guns for applying caulking material in joints either to seal the joints, to improve their esthetic appearance and/or prior to painting.

One common example of a replaceable caulking cartridge and caulking gun is illustrated in FIG. 1 of the accompanying drawings and is described in greater detail below. In any event, since each cartridge is used only for a short time, they are generally formed with a tubular nozzle of relatively thin and soft material, usually plastic. Normally, the user cuts off the end of the tubular nozzle to form an opening through which caulking material is ejected from the cartridge.

In most applications, the user moves the cartridge along a joint to be caulked for applying a continuous bead of caulking material. In most applications, it is desirable that the bead be formed with a continuous configuration for esthetic purposes. Usually, a coating of paint or the like is applied over the bead so that the configuration of the bead remains clearly apparent.

In applications of the type particularly contemplated by the present invention, the joint is formed between angularly aligned surfaces, for example, between wallboard or other wall surfaces and trim such as doors, windows, etc.

In various applications such as painting houses or other buildings, large numbers of cartridges are used and it is important that the user be able to apply a continuous bead as noted above in a rapid manner while using up substantially all of the caulking material available from each cartridge for purposes of economy.

Accordingly, there has been found to remain a need for improved tips for use on such cartridges to apply the caulking material. As noted above, a great number of designs for caulking guns and the like have been made available in the prior art. For example, U.S. Pat. No. 3,121,516 issued Feb. 18, 1964 to De Wees et al disclosed a cartridge and caulking gun combination including a discharge control device or nozzle formed integrally with the cartridge.

With the nozzle being tapered, it could be cut off at any point along its length by the user depending, for example, upon the size of bead desired. However, since the nozzle was intended only for use during the life of the cartridge, it was formed from a relatively soft, thin plastic material. For that reason, the nozzle tended to become abraded or roughened at its outlet orifice, interfering with subsequent smooth bead formation. The roughened or abraded tip of the nozzle tended to cause skipping and undesirable discontinuities in the bead being formed U.S. Pat. No. 3,188,057 issued June 8, 1965 to Trumbull disclosed yet another caulking device wherein the nozzle was separately formed from and threaded onto the cartridge to form an outlet for caulking material. However, that nozzle otherwise appeared to have the same limitations referred to above.

Other examples of caulking devices were also disclosed in U.S. Pat. Nos. 3,058,632; 3,076,225; 3,439,839; 3,997,085 and 4,311,258. However, the caulking tips provided in those patents were also generally similar to those referred to above and that shown in FIG. 1 of the accompanying drawings and described in greater detail below.

The wall surfaces contacted by the nozzle or tip during application of the caulking material also present a particularly severe condition for the tip. The present invention particularly contemplates caulking in joints formed between angularly aligned surfaces. For example, it is necessary or desirable to caulk joints formed between the wall surfaces and trim including doors, windows and the like. In such applications, the walls are typically formed from wallboard and are covered with taping compounds, or texturing material or other material applied to the wallboard or sheetrock before caulking of the joints noted above. The above compounds typically include sand or other highly abrasive materials. Accordingly, they tend to cause very high wear rates on normal caulking tips of the type referred to above.

There has been found to remain a need for an improved replaceable tip to facilitate application of caulking material in joints and elsewhere while facilitating formation of a smooth bead of caulking material.

SUMMARY OF THE INVENTION

It is therefore an object of the invention to provide an improved replaceable caulking tip for overcoming one or more problems of the type referred to above.

Furthermore, it is an object of the invention to provide a replaceable caulking tip having an outlet orifice formed with substantial body material surrounding the orifice to permit shaping of the tip about the periphery of the orifice, the orifice being elongated and inclined about 12 to 20 degrees, more preferably about 15 to 17 degrees, from a plane perpendicular to a longitudinal axis of the tip to facilitate caulking operations.

In order to provide substantial body material surrounding the orifice, as described above, at least an end portion of the body forming the orifice with an annular wall thickness of at least about 0.015 inches. Preferably, the wall thickness is in the range of about 0.015–0.060 inches, more preferably in the range of about 0.020–0.030 inches, the wall thickness for any particular tip also being dependent upon the orifice size. Specific wall thicknesses for different orifice sizes are discussed in greater detail below.

It is a particularly important feature of the invention to provide the combination of (1) the orifice being elongated, (2) the orifice being inclined as noted above, and (3) the body material surrounding the periphery of the orifice being rounded or faired. After substantial experimentation, it was found that these three features in combination are essential in the formation of a desirably caulked joint of the type contemplated by the invention. In particular, the angular alignment of the orifice is necessary to facilitate an operator being able to caulk a joint, for example, from ceiling to floor, in a single stroke. At the same time, the elongated configuration of the orifice and the faired body material about the orifice cause the tip to be self-wiping so that very smooth bead is formed along the entire length of the joint without the need to wipe the joint in a separate operation.

Yet another important feature of the invention is to assure that the longitudinal axis of the elongated orifice is parallel with the axis of inclination for the orifice. In other words, during use of the tip, it is desirable that the elongated orifice be positioned so that its longitudinal axis is parallel to the joint being caulked and the direction of travel for the tip along the joint. This same relationship is also necessary for the axis of inclination for the orifice.

It is yet a further object of the invention to provide a replaceable caulking tip of the type referred to immediately above wherein the body is formed of a material having suitable composition and hardness for resisting or minimizing wear during repeated use of the tip and for permitting initial forming of the tip and reshaping if necessary Accordingly, characteristics of the body material including composition and hardness are also important together with the three features discussed above. At the same time, the material of the body must be selected to facilitate economical formation of the tip during manufacture. Yet another related feature of the invention is selection of the material forming the tip so that it does not leave an undesirable mark along the joint being caulked.

Preferred materials for meeting the various objects set forth above are described in greater detail below. Generally, it has been found desirable to employ a metal having a Rockwell Hardness in the range of about B75 to about B95. However, the composition of the tip is equally important. Preferably, the invention contemplates the use of either low carbon or medium carbon steels which are preferably cold drawn to provide both the necessary hardness or wearability and yet be machinable.

It is yet another object of the invention to provide a method for forming the tip to assure proper interaction of the various features noted above. The method comprises the steps of forming a tubular body of a selected material, providing indexing means on the tubular body to assure proper angular alignment of the body during subsequent steps, grinding or cutting the inclined surface of the tip orifice, elongating the orifice, for example, by a crimping operation, the indexing means being employed during both the inclining and elongated steps, and then shaping the orifice periphery to form a rounded or faired configuration.

Additional objects and advantages of the invention are made apparent in the following description having reference to the accompanying drawings

BRIEF DESCRIPTION OF THE DRAWING

FIG. 1 is a side view in elevation of a prior art caulking gun and cartridge.

FIG. 2 is an enlarged side view in elevation of a replaceable caulking tip according to the present invention, the caulking tip being engaged upon the nozzle of a cartridge such as that illustrated in FIG. 1 with only a portion of the nozzle being shown.

FIG. 3 is a view taken along section line III—III of FIG. 2, FIG. 2 in turn being a view taken along section line II—II of FIG. 3.

FIGS. 4 and 5 are views respectively taken along section lines IV—IV and V—V of FIG. 3.

FIG. 6 is an end view of the threaded portion of the caulking tip of FIG. 5.

FIG. 7 is a fragmentary view of an end portion of the caulking tip including the orifice together with a cap.

FIG. 8 is a block diagram illustrating a preferred method for forming the caulking tip of the invention.

DESCRIPTION OF THE PREFERRED EMBODIMENTS

Referring now to the drawings and particularly to FIGS. 2-5, a replaceable tip is generally indicated at 10 for use on caulking cartridges and the like to facilitate the smooth deposit of caulking material and to allow repeated use of the caulking tip over extended periods of time.

In order to better illustrate the manner of use contemplated for the replaceable caulking tip 10, a prior art cartridge 12 and caulking gun 14 are shown in FIG. 1. Referring to FIG. 1, the cartridge 12 fits within the caulking gun 14 which can be operated by a trigger 16 for causing a plunger 18 to move through the cartridge 12 with caulking material being ejected through a tapered nozzle 20.

The tapered nozzle 20 is generally formed of relatively thin, soft plastic so that it can be cut off at any point along its length to form an outlet orifice of varying size. For example, the closed end of the nozzle 20 may, for example, be cut off along the line indicated at 22 in order to allow caulking material to be ejected through the nozzle. However, the plastic material forming the nozzle would be subject to rapid wear as noted above and would thereafter tend to interfere with the formation of a smooth, continuous bead of caulking material The present invention has eliminated that problem by providing the replaceable caulking tip 10. As may be best seen in FIGS. 4 and 5, the caulking tip 10 has an elongated hollow body 24 formed from relatively hard material, preferably metal but possibly also hard plastics or the like. At the same time, the material of the body 24 is selected so that it can be filed or otherwise worked in order to permit initial formation of the various features of the caulking tip and restoration of the rounded periphery of the orifice as described in greater detail below.

One end 26 of the body 24 is formed with internal threads 28 so that the body can be threaded onto an outlet nozzle for a cartridge such as the nozzle 20 illustrated in FIG. 1. In this regard, the tip is self-threading with the internal threads 28 tending to deform or cut through into the plastic nozzle. In any event, the internal threads 8 are effective for assuring engagement of the caulking tip onto the outlet nozzle.

A fragmentary portion of the nozzle 20 is illustrated in FIG. 2 to demonstrate the manner in which the replaceable tip 10 is mounted thereupon. The internal threads 28 also permit the caulking tip 10 to be removed from the nozzle 20 after the supply of caulking material from the cartridge 12 has been exhausted. Thereafter, the replaceable caulking tip 10 may similarly be used with one or more additional cartridges.

The body 24 of the tip 10 is formed with an internal passage 30 along its length terminating at an outlet orifice 2 formed on the opposite end 34 of the body.

As may be best seen in FIGS. 3-5, the body 24 is formed with substantial body material about the periphery of the orifice 32 to facilitate formation of a rounded or faired shape 36 about the periphery of the orifice 32. The caulking tip 10 may be supplied with the body material being rounded or faired about the orifice or with a relatively blunt end so that the user may taper or round the body material about the orifice as desired.

Generally, it has been found that the body 24 adjacent the orifice 32 must have an annular wall thickness of at least about 0.015 inches in order to permit proper shaping about the orifice. More preferably, it is contemplated that the body 24 adjacent the orifice has an annular wall thickness in the range of about 0.015–0.060 inches, more preferably in the range of about 0.020–0.035 inches. However, the particular thickness for any given tip depends at least in part upon the size of the orifice. Only for purposes of illustration, it is noted that caulking tips have been formed with inside diameters in the range of from 0.0938 inches to 0.1875 inches. For that range of inside diameters, the wall thickness preferably vary from about 0.020 to about 0.030 inches.

As noted above, the orifice 32 is inclined about 12 to 20 degrees, more preferably about 15 to 17 degrees, from a plane 38 perpendicular to the longitudinal axis of the caulking tip 10 and accordingly the cartridge 12 of FIG. 1.

At the same time, the orifice 32 is formed with an elongated configuration as best illustrated in FIG. 3. In other words, the orifice 32 is formed with a dimension illustrated in cross section in FIG. 4 which is substantially greater than the dimension for the orifice illustrated in cross section by FIG. 5. Typically, the orifice is elongated, for example, by crimping or similar shaping, so that the longitudinal dimension of the elongated orifice is approximately 50% to 100% greater than the lateral dimension of the elongated orifice.

It has also been found necessary to assure proper alignment of the elongated orifice relative to the angle of inclination for the orifice 32 as illustrated in FIG. 4. The angle of inclination for the orifice is arranged substantially parallel or co-linear with the axis of elongation for the orifice. In this regard, the axis of inclination is indicated at 42 in FIG. 4 while the axis of elongation for the orifice is indicated at 44 in FIG. 3.

The caulking tip 10 is also preferably formed with an enlarged flange or projection 40 which is knurled or otherwise roughened to permit the user to more easily grip the caulking tip 10 and thread it into place on the nozzle.

In order to assure proper angular alignment of the tubular body during various steps of the methods for forming the tip, an indexing notch 46 is formed on the one end of the tubular body adjacent the internal threads 28. The manner in which the notch is used during manufacturing is described in greater detail below.

Substantial experimentation was necessary to determine a preferred metal for forming the tubular body of the caulking tip. As noted above, the composition and hardness of the body was selected to assure durability of the tip even in engagement with abrasive surfaces as described above. At the same time, it was necessary to maintain workability in order to permit proper initial formation of the tip and to permit the tip to be restored during use if necessary Certain metals such as brass and aluminum are commonly considered for applications where machining is necessary. However, tips formed from these metals were found to exhibit excessive wear and also to leave undesirable marks on the joint surfaces. Similarly, metals containing substantial quantities of lead were found to be undesirable because of a tendency to mark the joint surfaces.

Although these shortcomings could be overcome, for example, by hardening the metals, it was found preferable to employ certain steel alloy compositions having a general Rockwell Hardness in the range of about B75 to B95. Such a range of alloys, termed generally medium carbon or low carbon fields, were found to be available from LaSalle Field Company under the type designations "1018", "1117", "1045", "1141", "1144", "1215" and "12L14". These metals were further characterized as being cold drawn.

Certain of the alloy compositions noted above were less desirable than others. For example, the alloy indicated as type 1117 included higher amounts of lead and was found to be satisfactory in performance but tended to leave a mark on the joint surfaces. Similarly, the other compositions illustrated one or more advantages or shortcomings.

The alloy indicated as type 12L14 was found to be superior in that it exhibited desirable hardeners and durability while also being more readily machinable than the other alloys. Thus, this alloy was found not only to produce a superior tip but also to permit more rapid manufacture of the tip. The composition indicated as type 12L14 was further identified as having a Rockwell Hardness of B85. In addition, this alloy was categorized as a leaded, resulphurized and rephosphorized low carbon steel. Generally, the type designations noted above are also standards for AISI/SAE.

The manner of use for the caulking tip 10 is believed apparent from the preceding description but is described briefly below in order to assure a more complete understanding of the invention.

Initially, with the replaceable caulking tip 10 used on a cartridge such as that indicated at 12 in FIG. 1, the tapered nozzle 20 is first cut off, for example, along the line 22 to allow caulking material to flow out of the cartridge.

The caulking tip 10 is then threaded onto the nozzle as illustrated in FIG. 2 with the internal threads 28 serving to engage the tip upon the nozzle 20. With the caulking tip in place, a user can then employ the caulking gun 14 of FIG. 1 or any other caulking device in a generally conventional manner. However, the configuration of the caulking tip 10 particularly facilitates the caulking operation and formation of a smooth caulked joint. In particular, it is noted again that the combination of the elongated orifice, inclination of the orifice and the fairing about the orifice all contribute to permit caulking of relatively long joints in a single stroke without the need to wipe the joint in a separate step The tip 10 also has greater versatility because of the elongated orifice 32. Although it is preferred to employ the tip with the axes of elongation for the orifice and the axis of inclination for the orifice both being parallel to the joint, it is also possible for a user to employ the tip with the longitudinal axis of the orifice perpendicular to the joint. Such a technique may be useful in special circumstances, for example, to effectively vary the width of a bead formed in the joint.

Furthermore, after caulking material is exhausted from each cartridge such as that indicated at 12 in FIG. 1, the caulking tip 10 may be rapidly removed and similarly replaced on a substitute cartridge so that the caulking operation can be continued.

If the caulking tip 10 exhibits wear or erosion about the orifice 32, the user can reconfigure the rounded or faired shape of the body about the orifice, for example, by means of a file or rasp (not shown). In that manner, he can readily reform the desired configuration of the tip, making it useful over longer periods of time.

Operation of the caulking tip is further enhanced by the provision of a flexible cap 48 which is adapted to fit over the orifice end of the tip. Thus, the cap 48 may be installed on the tip during periods of nonuse to prevent caulking material within the tip from hardening. Thus, when a user is ready to recommence caulking operations, he may merely remove the cap 48 and continue. This of course avoids the need for cleaning caulking material from the tip during periods of nonuse. Also, when the cap 48 is not being used on the tip as illustrated in FIG. 7, it is also sized so that it can be stored on a portion of the caulking gun. Referring for example to the caulking gun 14 in FIG. 1, the cap 48 may be stored if desired on the exposed end of the plunger 18.

In manufacture, the tubular body of the caulking tip is first formed with the tapered configuration illustrated in the drawings. As can be seen from FIGS. 4 and 5, the hollow body which forms the caulking tip is a single piece of material so that the caulking tip has a unitary structure. According to the present invention, the indexing notch 46 is then formed in the one end of the tubular body. Thereafter, the 15 degree angular inclination illustrated in FIG. 4 is formed, for example, by grinding or cutting with the indexing notch 46 being employed to establish a selected angular alignment of the tubular body relative to the axis of inclination 42. The orifice is then elongated, for example, by crimping or similar shaping. Here again, the indexing notch 46 is employed to assure proper angular alignment of the tubular body so that the axis of elongation 44 for the orifice is parallel or co-linear with the axis of inclination 42. Thereafter, the periphery of the orifice is shaped to have the rounded or faired configuration described above. In this manner, a superior caulking tip is formed having the unique combination of features described above.

It will also be noted from the above description and the drawings, particularly drawings 3, 4, and 5, that the caulking tip has a longitudinal axis along the length of the tubular body and the outlet orifice has an elongated planar configuration wherein the orifice has a greater dimension in one direction than in the other, thereby forming an axis of elongation. It will also be apparent that the axis of elongation is on a line which is inclined from a plane perpendicular to the longitudinal axis and the orifice has two sides (50) which are substantially parallel to each other and to the axis of elongation.

There has thus been disclosed a particularly advantageous replaceable caulking tip having numerous features making it particularly useful for caulking operations Variations and modifications in addition to those suggested above are believed apparent Accordingly, the scope of the invention is defined only by the following appended claims.

What is claimed is:

1. A caulking tip for replaceable use on a tubular nozzle of a caulking cartridge or the like; said tip being adapted for caulking joints between angularly aligned surfaces; said tip comprising a tubular body having a passage therethrough and an opening at one end for attaching the caulking tip to the nozzle of the caulking cartridge and an outlet orifice at the other end;

said caulking tip having a longitudinal axis along the length of the tubular body and said outlet orifice having an elongated planar configuration wherein the orifice has a greater dimension in one direction than in the other, thereby forming an axis of elongation;

said axis of elongation being on a line which is inclined from a plane perpendicular to the longitudinal axis; and said orifice having two sides which are substantially parallel to each other and to the axis of elongation whereby the substantially parallel sides provide an elongated length for contacting angularly aligned surfaces of a joint during a caulking procedure.

2. The caulking tip of claim 1, wherein the axis of elongation is inclined about 12–20 degrees from the plane perpendicular to the longitudinal axis.

3. The caulking tip of claim 2, wherein the axis of elongation is inclined about 15–17 degrees from the plane perpendicular to the longitudinal axis.

4. The caulking tip of claim 2, wherein internal threads are provided at the end for attaching the caulking tip to the nozzle of the caulking cartridge.

5. The caulking tip of claim 2, wherein the tubular body is made from metal.

6. The caulking tip of claim 3, wherein the tubular body is made from metal.

7. The caulking tip of claim 2, wherein the tubular body is made from hard plastic.

8. The caulking tip of claim 3, wherein the tubular body is made from hard plastic.

9. The caulking tip of claim 4, wherein the end having internal threads is enlarged and knurled or roughened to facilitate threading of the tip onto the tubular nozzle.

10. The caulking tip of claim 1, wherein the end of the tubular body defining the outlet orifice is rounded or faired about the periphery of the orifice to facilitate movement of the tip along a joint to be caulked.

11. The caulking tip of claim 1, wherein the metal is cold finished low carbon steel.

12. The caulking tip of claim 3, wherein the metal is cold finished low carbon steel.

13. The caulking tip of claim 1, wherein the tubular body has an annular wall thickness of at least 0.015 inches to provide substantially material surrounding the orifice.

14. The caulking tip of claim 13, wherein the annular wall thickness is about 0.015–0.060 inches.

15. The caulking tip of claim 14, wherein the annular wall thickness is about 0.020–0.035 inches.

16. The caulking tip of claim 1, wherein the two sides of the orifice are formed substantially parallel to each other by means of crimping the two sides of the orifices on either side of the axis of elongation.

17. A one piece caulking tip of replaceable use on the tubular nozzle of a caulking cartridge or the like; said tip being adapted for caulking joints between angularly aligned surfaces; said tip comprising a single tubular body of unitary structure having a passage therethrough and an opening at one end for attaching the caulking tip to the nozzle of the caulking cartridge and an outlet orifice at the other end;

said end of the tubular body defining the outlet orifice being rounded or faired about the periphery of the orifice to facilitate movement of the tip along a joint to be caulked;

said caulking tip having a longitudinal axis along the length of the tubular body and said outlet orifice having an elongated planar configuration wherein the orifice has a greater dimension in one direction than in the other, thereby forming an axis of elongation;

said axis of elongation being on a line which is inclined from a plane perpendicular to the longitudinal axis; and said orifice having two sides which are substantially parallel to each other and to the axis of elongation whereby the substantially parallel sides provide an elongated length for contacting the angularly aligned surfaces of a joint during a caulking procedure.

18. The caulking tip of claim 17 which further includes an indexing notch on the end of the tubular body opposite the outlet orifice so that a crimping operation performed on the tubular body results in the two sides of the orifice being substantially parallel to each other and to the axis of elongation.

19. A method for forming a caulking tip for replaceable use on a tubular nozzle of a caulking cartridge or the like comprising the steps of:

forming a tubular body having an opening at each end for the passage of caulking material therethrough, said tubular body having a longitudinal axis;

providing means for releasable engagement of one end of the tubular body with the nozzle of the caulking cartridge;

forming an outlet orifice in an elongated planar configuration at the other end of the tubular body for the passage of caulking material therethrough;

said outlet orifice being inclined at an angle with respect to a plane perpendicular to the longitudinal axis so that the inclined orifice is in the form of an elongated planar configuration wherein the orifice has a greater dimension in one direction than in the other direction thereby forming an axis of elongation; and crimping the orifice on either said of the axis of elongation to enhance the elongated configuration along said axis of elongation and to form an orifice having two sides which are substantially parallel to each other and to the axis of elongation.

20. The method of claim 19, which further includes the steps of forming an indexing notch on the end of the tubular body opposite the orifice and employing said notch to establish angular alignment during the crimping step so that the two sides of the orifice or crimped to form an orifice having two sides which are substantially parallel to each other and to the axis of elongation.

21. The method of claim 19, wherein the orifice is inclined about 12–20 degrees.

22. The method of claim 21, wherein the orifice is inclined about 15–17 degrees.

* * * * *